US006599688B1

(12) United States Patent
Haye et al.

(10) Patent No.: US 6,599,688 B1
(45) Date of Patent: Jul. 29, 2003

(54) STABLE PHOTOGRAPHIC COLOR DEVELOPING COMPOSITION AND METHOD OF USE

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/076,986

(22) Filed: Feb. 15, 2002

(51) Int. Cl.[7] ..... G03C 7/413
(52) U.S. Cl. ..... 430/490
(58) Field of Search ..... 430/490

(56) References Cited

U.S. PATENT DOCUMENTS

| | | | | |
|---|---|---|---|---|
| 4,756,997 | A | 7/1988 | Marchesano | 430/478 |
| 4,876,174 | A | 10/1989 | Ishikawa et al. | 430/380 |
| 4,892,804 | A | 1/1990 | Vincent et al. | 430/380 |
| 5,273,865 | A | 12/1993 | Loiacono et al. | 430/490 |
| 5,354,646 | A | 10/1994 | Kobayashi et al. | 430/372 |
| 5,660,974 | A | 8/1997 | Marrese et al. | 430/490 |
| 6,077,651 | A | 6/2000 | Darmon et al. | 430/466 |

FOREIGN PATENT DOCUMENTS

| | | |
|---|---|---|
| EP | 0 204 372 | 12/1986 |
| EP | 0 531 582 | 3/1993 |
| EP | 0 800 111 | 10/1997 |

OTHER PUBLICATIONS

U.S. Ser. No. 10/076,986 (D–84021) filed on even date herewith, titled "Stable Multi–Part Photographic Color Developing Composition And Method Of Use" by Haye et al.

*Primary Examiner*—Hoa Van Le
(74) *Attorney, Agent, or Firm*—J. Lanny Tucker

(57) ABSTRACT

Concentrated and working strength photographic color developing compositions are stabilized with the inclusion of an α-ketocarboxylic acid or salt thereof, such as pyruvic acid or a salt thereof. These compositions can be used to process color photographic materials.

22 Claims, 2 Drawing Sheets

STABLE PHOTOGRAPHIC COLOR DEVELOPING COMPOSITION AND METHOD OF USE

FIELD OF THE INVENTION

Figure 1:
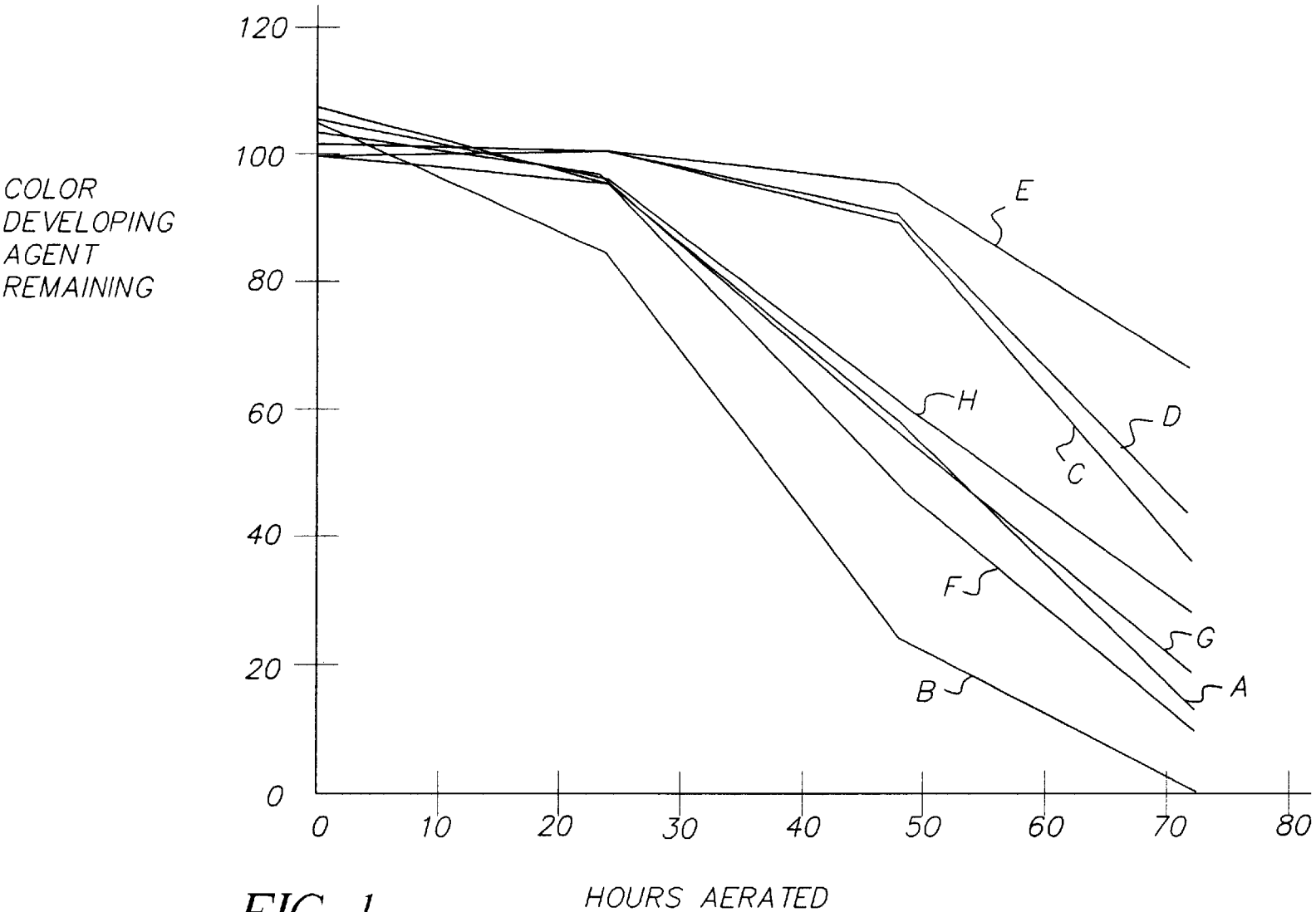

The present invention relates to concentrated and working strength photographic color developing compositions that have improved stability, and to methods for their use. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (Ishikawa et al.), U.S. Pat. No. 5,354,646 (Kobayashi et al.), and U.S. Pat. No. 5,660,974 (Marrese et al.).

It is generally known that the concentrations of various photochemicals used in a photographic color developing composition must be within certain narrow limits in order to provide optimal performance. This is particularly true of "concentrates" or single-part compositions.

There is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

One concentrated form known in the art is a chemical paste or slurry, as described for example in EP-A-0 204,372 (Chemco) and EP-A-0 800,111 (Fuji Photo). These formulations have still other disadvantages, namely lack of homogeneity and slow dissolution rate of solid components.

Additional small volume, ready to use color developing compositions are described in U.S. Pat. No. 5,273,865 (Loiacono et al.). These compositions are said to be free of bromides, hydroxylamines and benzyl alcohol, to include a polyol compound having 4 to 8 hydroxy groups, and to be useful for rapid access processing of photographic elements having high silver bromide emulsions only.

A very useful single-part color developing composition that is homogeneous, concentrated, and stable is described and claimed in U.S. Pat. No. 6,077,651 (Darmon et al.). Such compositions are stable from the presence of the free base form of the color developing agent and a particular amount of water-soluble organic solvent.

Stability of the color developing agents in such compositions is generally achieved using sulfite ions or any of the many conventional organic antioxidants (or preservatives) that reduce aerial oxidation rates. For example, U.S. Pat. Nos. 4,892,804, 4,876,174, 5,354,646, and 5,660,974 (all noted above) describe hundreds of possible derivatives of hydroxylamines that can be used as antioxidants in color developing compositions.

However, there is a desire in the photoprocessing industry to find additional means of stabilizing color developing compositions, especially concentrated compositions. There is also a desire to reduce the amounts of organic antioxidants for a number of reasons without losing the ability to reduce aerial oxidation.

SUMMARY OF THE INVENTION

This invention addresses the problems noted above with a concentrated aqueous photographic color developing composition having a pH of from about 7 to about 13 and comprising:

a) at least 0.005 mol/l of a color developing agent, b) at least 0.005 mol/l of an antioxidant for the color developing agent, and c) from about 0.01 to about 2.5 mol/l of an α-ketocarboxylic acid or salt thereof as a stabilizing agent.

This invention also provides a concentrated, aqueous, single-part color developing composition having a pH of from about 8 to about 12 and comprising:

a) from about 0.005 to about 1 mol/l of a color developing agent in free base form, b) from about 0.005 to about 1 mol/l of a hydroxylamine derivative antioxidant for the color developing agent, c) a water-miscible or water-soluble hydroxy-substituted, straight-chain organic solvent that has a molecular weight of from about 50 to about 200, d) a buffering agent that is soluble in the organic solvent, e) from about 0.005 to about 0.3 mol/l of a calcium ion sequestering agent, and f) at least 0.01 mol/l of an α-ketocarboxylic acid, or a salt thereof, as a stabilizing agent.

An aqueous working strength color developing composition of this invention has a pH of from about 7 to about 13 and comprises:

a) at least 0.0005 mol/l of a color developing agent, b) at least 0.0005 mol/l of an antioxidant for the color developing agent, and c) from about 0.005 to about 0.25 mol/l of an α-ketocarboxylic acid or salt thereof as a stabilizing agent.

An aqueous working strength color developing composition can also be prepared by diluting the concentrated aqueous color developing composition described above at least two times.

Further, a method for providing a color image in a color photographic silver halide element comprises contacting the element with the concentrated aqueous photographic color developing composition described above.

Alternatively, a method for providing a color image in a color photographic silver halide element comprises contacting the element with an aqueous working strength color developing composition that is prepared by diluting the concentrated aqueous color developing composition described above at least two times.

Still further, a method of photographic processing comprises the steps of:

A) color developing an imagewise exposed color photographic silver halide element with a photographic color developing composition comprising an α-ketocarboxylic acid or salt thereof, and B) desilvering the color developed color photographic silver halide element.

The color developing step in a photographic processing method can be followed by desilvering the color developed color photographic silver halide element, as well as any other useful photoprocessing steps known in the art.

The color developing composition of this invention offers a number of advantages over the color developing compositions currently available or known in the art. The concentrated and working strength compositions of this invention are stabilized with the presence of an α-ketocarboxylic acid or a salt thereof. This means that the chemical loss (breakdown) of color developing agent is reduced. Moreover, the amount of conventional organic antioxidants, such as hydroxylamine derivatives, can be reduced without sacrificing composition stability. This may allow for reduced odors or component costs by using less hydroxylamine derivatives in the compositions.

DETAILED DESCRIPTION OF THE INVENTION

In one embodiment, the color developing composition of this invention can be formulated as an aqueous concentrate, such as a single-part concentrate, that can then be diluted at least two times with water or buffer (preferably at least four times) to form a working strength color developing composition. Alternatively, the working strength composition of this invention can be prepared by mixing all of the desired components in any desired order at working strength concentrations.

The compositions of this invention contain one or more color developing agents that may be in the form of a sulfate salt or in free base form as a first essential component. Other components of the composition include one or more antioxidants for the color developing agent, one or more ketocarboxylic acids (or salts thereof), as described below, and one or more optional addenda described below.

More specifically, the color developing compositions of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (Sep. 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In preferred embodiments, the color developing agents are used in "free base form" as described in U.S. Pat. No. 6,077,651 (noted above).

In order to protect the color developing agents from oxidation, one or more antioxidants are generally included in the color developing compositions as a second essential component. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Mixtures of compounds from the same or different classes of antioxidants can also be used if desired.

Especially useful antioxidants are hydroxylamine derivatives as described for example, in U.S. Pat. No. 4,892,804 (noted above), U.S. Pat. No. 4,876,174 (noted above), U.S. Pat. No. 5,354,646 (noted above), U.S. Pat. No. 5,660,974 (noted above), and U.S. Pat. No. 5,646,327 (Burns et al.), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. More preferably, the hydroxylamine derivatives comprise one or more sulfo, carboxy, or hydroxy solubilizing groups.

Some preferred hydroxylamine derivative antioxidants include N,N-diethylhydroxylamine, N-isopropyl-N-ethylsulfonatohydroxylamine, and N,N-diethylsulfonatohydroxylamine.

The noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.), incorporated herein by reference, and include N,N-bis(2,3-dihydroxypropyl) hydroxylamine, N,N-bis(2-methyl-2,3-dihydroxypropyl) hydroxylamine and N,N-bis(1-hydroxymethyl-2-hydroxy-3-phenylpropyl)hydroxylamine.

Many of the noted antioxidants (organic or inorganic) are either commercially available or prepared using starting materials and procedures described in the references noted above in describing hydroxylamines.

A third essential component of the color developing compositions of this invention includes one or more α-ketocarboxylic acids (or metal salts thereof) as stabilizing agents. Preferably, these compounds include an aliphatic group. Representative stabilizing agents include, but are not limited to, pyruvic acid, oxalacetic acid, glyoxylic acid, mesoxalic acid, 2-ketobutyric acid and 2-ketoglutaric acid. Pyruvic acid, glyoxylic acid, and their salts are preferred. Pyruvic acid is preferred in the single-part concentrates of this invention. Mixtures of these stabilizing agents can be used if desired. These stabilizing agents can be provided as ammonium, alkali metal or alkaline earth metal salts such as sodium salts. The stabilizing agents can be obtained from a suitable supplier of chemical compounds such as Aldrich Chemical Company.

Buffering agents are generally present in the color developing compositions of this invention to provide or maintain desired alkaline pH of from about 7 to about 13, and preferably from about 8 to about 12. These buffering agents are preferably soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An optional but preferred component of the color developing compositions of this invention (especially the "single-part" compositions) is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are most preferred. The most preferred organic solvent is diethylene glycol.

Another optional but preferred component of the color developing composition of this invention is a calcium ion sequestering agent such as a polycarboxylic acid or a polyaminopolyphosphonic acid (or salts thereof). Mixtures of these compounds can also be used. There are many such compounds known in the art including U.S. Pat. No. 4,546,068 (Kuse), U.S. Pat. No. 4,596,765 (Kurematsu et al.), U.S. Pat. No. 4,892,804 (noted above), U.S. Pat. No. 4,975,357 (Buongiorne et al.), U.S. Pat. No. 5,034,308 (Abe et al.), and *Research Disclosure* publications Item 20405 (April, 1981), Item 18837 (December, 1979), Item 18826 (December, 1979), and Item 13410 (December, 1975).

Phosphonic acid metal ion sequestering agents are well known in the art, and are described for example in U.S. Pat. No. 4,596,765 (noted above) and Research Disclosure publications Item 13410 (June, 1975), 18837 (December, 1979), and 20405 (April, 1981).

Useful sequestering agents are readily available from a number of commercial sources. Particularly useful phosphonic acids are the diphosphonic acids (and salts thereof) and polyaminopolyphosphonic acids (and salts thereof) described below. It is preferable to use one or more compounds of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

Particularly useful polyphosphonic acids (and salts thereof) are compound that have at least five phosphonic acid (or salt) groups (herein "First Calcium Ion Sequestering Agent"). A mixture of such compounds can be used if desired. Suitable salts include ammonium and alkali metal ions salts.

Preferred compounds of this nature can be represented by the following Structure I:

I

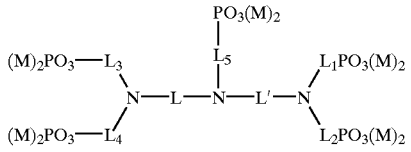

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

A particularly useful First Calcium Ion Sequestering Agent is diethylenetriaminepentamethylenephosphosphonic acid or an alkali metal salt thereof (available as DEQUEST™ 2066 from Solutia Co.).

Still another optional but preferred calcium ion sequestering agent is a diphosphonic acid (or salt thereof), herein referred to as "Second Calcium Ion Sequestering Agent".

One useful class of Second Calcium Ion Sequestering Agents includes hydroxyalkylidene diphosphonic acids (or salts thereof). Mixtures of such compounds can be used if desired. Useful salts include the ammonium and alkali metal ion salts.

Preferred hydroxyalkylidene diphosphonic acids (or salts thereof) can be represented by the following Structure II.

II

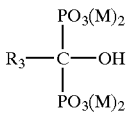

wherein $R_3$ is a substituted or unsubstituted alkyl group having 1 to 5 carbon atoms (methyl, methoxymethyl, ethyl, isopropyl, n-butyl, t-butyl and n-pentyl) and M is hydrogen or a monovalent cation (such as ammonium or alkali metal ions). Preferably, $R_3$ is methyl or ethyl, and most preferably, it is ethyl.

Representative Second Calcium Ion Sequestering Agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010, and its tetrasodium salt is available as DEQUEST™ 2016D, both from Solutia Co.

Another useful Second Calcium Ion Sequestering Agent is morpholinomethanediphosphonic acid or a salt thereof that is available as BUDEX™ 5103 from Budenheim (Germany). This and similar cyclicaminodiphosphonic acids (and salts thereof) are described in U.S. Pat. No. 4,873,180 (Marchesano et al.).

It is also possible to include other metal ion sequestering agents (for example, for iron, copper, and/or manganese ion sequestration) in the color developing composition as long as the other conditions of the invention are met.

The color developing compositions of this invention can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure* publications noted above]. The amounts of such additives are well known in the art also. Representative color developing compositions of this invention are described below in the examples.

It is preferred that no lithium or magnesium ions are purposely added to the color developing compositions of this invention. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

The following TABLES I and II list the general and preferred amounts of the essential and some optional components of the color developing compositions (concentrates and working strength compositions, respectively) of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I (CONCENTRATES)

| COMPONENT | CON-CENTRATIONS |
|---|---|
| Color developing agent(s) | 0.005–1 mol/l |
| | (0.05–0.8 mol/l) |
| Antioxidant(s) | 0.005–1 mol/l |
| | (0.05–1 mol/l) |
| α-Ketocarboxylic acid(s) | 0.01–2.5 mol/l |
| (or salts) | (0.02–2 mol/l) |
| Organic solvent(s) to water | 0.15:1 to 1.5:1 |
| (if organic solvent used) | (0.67:1 to 1.2:1) |
| Buffering agent(s) | 0.5–3 mol/l |
| | (1.5–2.5 mol/l) |
| First Calcium Ion | 0.005–0.3 mol/l |
| Sequestering Agent(s) | (0.01–0.1 mol/l) |
| Second Calcium Ion | 0–0.3 mol/l |
| Sequestering Agent(s) | (0–0.05 mol/l) |

TABLE II (WORKING STRENGTH)

| COMPONENT | CONCENTRATIONS |
|---|---|
| Color developing agent(s) | 0.0005–0.25 mol/l |
| | (0.005–0.03 mol/l) |
| Antioxidant(s) | 0.0005–0.25 mol/l |
| | (0.005–0.05 mol/l) |
| α-Ketocarboxylic acid(s) | 0.005–0.25 mol/l |
| (or salts) | (0.01–0.2 mol/l) |
| Buffering agent(s) | 0.002–0.8 mol/l |
| | (0.01–0.5 mol/l) |
| First Calcium Ion | 0.0005–0.05 mol/l |
| Sequestering Agent(s) | (0.001–0.01 mol/l) |
| Second Calcium Ion | 0–0.001 mol/l |
| Sequestering Agent(s) | (0–0.0008 mol/l) |

While the foregoing TABLES I and II show concentrations for First and Second Calcium Ion Sequestering Agents that are polyphosphonic acids it would be appreciated by one skilled in the art that other calcium ion sequestering agents (such as polycarboxylic acids) would be useful in similar or conventional amounts.

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well. The color developing composition can also be used in processing of color reversal and color negative films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE 5, 7, 8, and 9 Color Papers (Eastman Kodak Company), KODAK EKTACOLOR ROYAL VII and VIII Color Papers (Eastman Kodak Company), KODAK PROFESSIONAL PORTRA IV Color Papers (Eastman Kodak Company), KODAK PROFESSIONAL SUPRA III and IV Color Papers (Eastman Kodak Company), KODAK PROFESSIONAL ULTRA III Color Papers (Eastman Kodak Company), KODAK PROFESSIONAL METALLIC Color Papers (Eastman Kodak Company), KODAK DURALIFE Color Paper (Eastman Kodak Company), KODAK PROFESSIONAL PORTRA Black and White Papers (Eastman Kodak Company), FUJI SUPER Color Papers (Fuji Photo Co., FA5, FA7 and FA9), FUJI CRYSTAL ARCHIVE and Type C and D Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK PROFESSIONAL DURATRANS display materials, KODAK DURACLEAR, KODAK EKTAMAX RAL and KODAK PROFESSIONAL DURAFLEX print materials, and KODAK PROFESSIONAL Digital ILL Color Paper Type can also be processed using the present invention. The compositions and constructions of such commercial color photographic elements could be readily determined by one skilled in the art.

Color development of an imagewise exposed photographic silver halide element is carried out by contacting the element with a color developing composition of this invention under suitable time and temperature conditions, in suitable processing equipment, to produce the desired developed color image. Additional processing steps can then be carried out using conventional procedures, including but not limited to, one or more color development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al.) and publications noted therein. Some minilab processing machines are commercially available as Noritsu 2211SM Printer/Paper Processor, Noritsu 2102SM Printer/Paper Processor, and Noritsu 2301SM Printer/Paper Processor.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al.) and U.S. Pat. No. 5,753,423 (Buongiorne et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003 (Ueda et al.), and ethylenediamine monosuccinic acid and similar compounds as described in U.S. Pat. No. 5,691,120 (Wilson et al.). Useful fixing agents are also well known in the art and include various thiosulfates and thiocyanates or mixtures thereof as described for example in U.S. Pat. No. 6,013,424 (Schmittou et al.).

Rinsing and/or stabilizing steps can be carried out after desilvering if desired using various rinsing or stabilizing compositions that may include one or more anionic or nonionic surfactants. Representative compositions for this purpose are, for example, described in U.S. Pat. No. 5,534,396 (McGuckin et al.), U.S. Pat. No. 5,578,432 (McGuckin et al.), U.S. Pat. No. 5,645,980 (McGuckin et al.), U.S. Pat. No. 5,667,948 (McGuckin et al.), and U.S. Pat. No. 5,716,765 (McGuckin et al.).

The processing time and temperature used for each processing step of the present invention are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers. Conventional conditions can be used for other processing steps including desilvering and rinsing/stabilizing.

The color developing composition of this invention can be used as a working strength solution, or as a replenisher. Alternatively, the concentrated compositions of this invention can be diluted at least two times (that is, one volume composition to one volume water or buffer), and preferably at least four times, and up to 8 times, to provide a working strength solution or replenisher.

The following examples are provided to illustrate the practice of this invention and not to limit it in any way. Unless otherwise indicated, percentages are by weight.

EXAMPLE 1

Color Developing Composition and Aeration Studies

A working strength color developing composition of this invention was prepared by adding sodium pyruvate to a color developing composition having the components and amounts (along with the Control compositions) shown in TABLE III below. The Control A composition is a large tank color developing composition with no pyruvate added. The Control B composition is similar but includes sodium pyruvate and the hydroxylamine derivative was omitted. All compositions were prepared and monitored as replicates under accelerated oxidation at 325 ml/min at room temperature in an open glass container. A decrease in volume due to evaporation was compensated for by periodically adding deionized water. The composition was analyzed periodically for the amount of remaining color developing agent and the change in pH. The results of these measurements are shown in the following TABLE IV. Composition stability or instability is evident by the loss in color developing agent (or loss in color developing agent activity).

The pH of each composition in TABLE III was adjusted to 10.10 using sulfuric acid or potassium hydroxide.

TABLE IV

| | KODAK Color Developing Agent CD-3 Remaining (%) | | |
|---|---|---|---|
| Time (hours) | Control A | Control B | Example 1 |
| 0 | 100 | 100 | 100 |
| 24 | 89.5 | 39.6 | 94.4 |
| 72 | 18.1 | 0 | 27.8 |

These results show that the Control B composition containing sodium pyruvate and no hydroxylamine derivative antioxidant is less stable than the standard color developing composition (Control A). In contrast, the Example 1 composition containing sodium pyruvate and one-half the conventional amount of the hydroxylamine derivative is significantly more stable than the Control A composition over the aeration time of 72 hours (which is the standard time for use of a composition during photoprocessing). The combination of sodium pyruvate and the hydroxylamine derivative appears to synergistically significantly improve the stability of the color developing composition. The Example 1 composition exhibited only a small pH loss.

EXAMPLES 2–4

Color Developing Compositions and Concentration Series

Three working strength color developing compositions of this invention were prepared and evaluated with combinations of a pyruvate and hydroxylamine derivative and compared to the conventional KODAK EKTACOLOR™ Prime RA Color Developer and Replenisher (Control C). The components of the compositions are shown in the following TABLE V. The composition were aerated at room temperature, and monitored periodically for the amount of remaining color developing agent, hydroxylamine derivative and changes in pH. Composition stability or instability is evident by the loss in color developing agent (or loss in color developing agent activity) and loss in hydroxylamine derivative (or loss in antioxidant activity). The results of

TABLE III

| | AMOUNT | | |
|---|---|---|---|
| COMPONENT | CONTROL A | CONTROL B | EXAMPLE 1 |
| Water | 800 ml | 800 ml | 800 ml |
| Triethanolamine (85%) | 6.47 ml | 6.47 ml | 6.47 ml |
| N,N-diethylhydroxylamine antioxidant | 5 ml (0.05 mol/l) | 0 | 2.5 ml (0.025 mol/l) |
| Sodium Pyruvate | 0 | 18.0 g (0.164 mol/l) | 18.0 g (0.164 mol/l) |
| Phorwite REU optical brightener | 1.0 g | 1.0 g | 1.0 g |
| Lithium sulfate | 2.0 g | 2.0 g | 2.0 g |
| Magnesium sulfate | 0.2 g | 0.2 g | 0.2 g |
| 1-Hydroxyethylidene-1,2-diphosphonic acid | 0.6 g | 0.6 g | 0.6 g |
| Potassium chloride | 6.40 g (0.086 mol/l) | 6.40 g (0.086 mol/l) | 6.40 g (0.086 mol/l) |
| Potassium bromide | 0.028 g | 0.028 g | 0.028 g |
| KODAK Color Developing Agent CD-3 | 4.35 g (0.01 mol/l) | 4.35 g (0.01 mol/l) | 4.35 g (0.01 mol/l) |
| Potassium carbonate | 25 g (0.18 mol/l) | 25 g (0.18 mol/l) | 25 g (0.18 mol/l) |
| Water | To make 1 liter | To make 1 liter | To make 1 liter |

these measurements are shown in the following TABLES VI and VII.

TABLE V

| Component | Amount | | | |
|---|---|---|---|---|
| | Control C | Example 2 | Example 3 | Example 4 |
| Water | 800 ml | 800 ml | 800 ml | 800 ml |
| Versa TL (sulfonated polystyrene) | 0.17 g | 0.17 g | 0.17 g | 0.17 g |
| Potassium sulfite (45%) | 0.84 g | 0.84 g | 0.84 g | 0.84 g |
| Triethanolamine (85%) | 7.3 g | 7.3 g | 7.3 g | 7.3 g |
| N,N-diethylhydroxylamine | 5.4 g (0.06 mol/l) | 5.4 g (0.06 mol/l) | 5.4 g (0.06 mol/l) | 2.7 g (0.03 mol/l) |
| Sodium Pyruvate | 0 | 3.0 g (0.027 mol/l) | 11.0 g (0.1 mol/l) | 11.0 g (0.1 mol/l) |
| Phorwite REU optical brightener | 1.1 g | 1.1 g | 1.1 g | 1.1 g |
| Lithium sulfate | 2.0 g | 2.0 g | 2.0 g | 2.0 g |
| Magnesium sulfate | 0.2 g | 0.2 g | 0.2 g | 0.2 g |
| DEQUEST ™ 2010 | 0.86 g | 0.86 g | 0.86 g | 0.86 g |
| Potassium chloride | 4 g | 4 g | 4 g | 4 g |
| Potassium bromide | 0.03 g | 0.03 g | 0.03 g | 0.03 g |
| Kodak Color Developing Agent CD-3 | 6.8 g (0.016 mol/l) | 6.8 g (0.016 mol/l) | 6.8 g (0.016 mol/l) | 6.8 g (0.016 mol/l) |
| Potassium hydroxide (50%) | 5 g | 5 g | 5 g | 5 g |
| Potassium carbonate (47%) | 52.6 g (0.18 mol/l) | 52.6 g (0.18 mol/l) | 52.6 g (0.18 mol/l) | 52.6 g (0.18 mol/l) |
| Water | To make 1 liter | To make 1 liter | To make 1 liter | To make 1 liter |

The pH of each composition in TABLE V was adjusted to 10.8 using sulfuric acid or potassium hydroxide.

TABLE VI

| Time (hours) | Kodak Color Developing Agent CD-3 Remaining (%) | | | |
|---|---|---|---|---|
| | Control C | Example 2 | Example 3 | Example 4 |
| 0 | 100 | 100 | 100 | 100 |
| 48 | 92.4 | 97.3 | 98.5 | 93.7 |
| 72 | 67.3 | 89.3 | 96.1 | 77.3 |
| 96 | 21.3 | 56.7 | 92.4 | 45.3 |

TABLE VII

| Time (hours) | Hydroxylamine Derivative Remaining (%) | | |
|---|---|---|---|
| | Control C | Example 2 | Example 3 |
| 0 | 100 | 100 | 100 |
| 24 | 68.3 | 77.5 | 77.9 |
| 48 | 23.1 | 49.0 | 51.9 |
| 72 | 0 | 14.7 | 26.9 |

It can be seen from TABLE VI that some combinations of hydroxylamine derivative antioxidant and pyruvate significantly improved the stability of the color developing agent over the aeration time period. In addition, TABLE VII shows that the pyruvate also significantly improved the stability (that is, reduced loss in activity) of the antioxidant in the color developing solutions.

EXAMPLE 5

Color Paper Processing

Samples of KODAK Edge 8 Color Paper were given a step wedge test object exposure at 1/10 sec with HA-50, NP-11 filters, and 0.3 Inconel on a conventional 1B sensitometer. The samples were then processed using the standard KODAK EKTACOLOR Prime Color Developer & Replenisher (Control C) or a working strength color developing composition of this invention that was prepared by adding sodium pyruvate (5.5 g/l, 0.05 mol/l) to the Control A composition. Processing was carried out in a deep tank processor using conventional EKTACOLOR Process RA-4 conditions and steps as follows:

| | | |
|---|---|---|
| Color Development | 38° C. | 45 seconds |
| Bleach/fixing | 35° C. | 45 seconds |
| Washing/Stabilizing | 35° C. | 90 seconds |

samples were allowed to dry in the air at ambient temperature. The desired colored images were obtained in all of the samples.

EXAMPLES 6–11

Stabilized Single-Part Color Developing Compositions

Several KODAK EKTACOLOR Prime SP single-part color developing compositions of this invention were prepared as described in the following TABLE VIII. The concentrations of pyruvate and hydroxylamine derivative antioxidant were varied as shown in the following TABLE XI. Control D is the conventional single-part concentrated composition and Control E was similar to it except that the amount of antioxidant was one-half as much.

Figure 2:
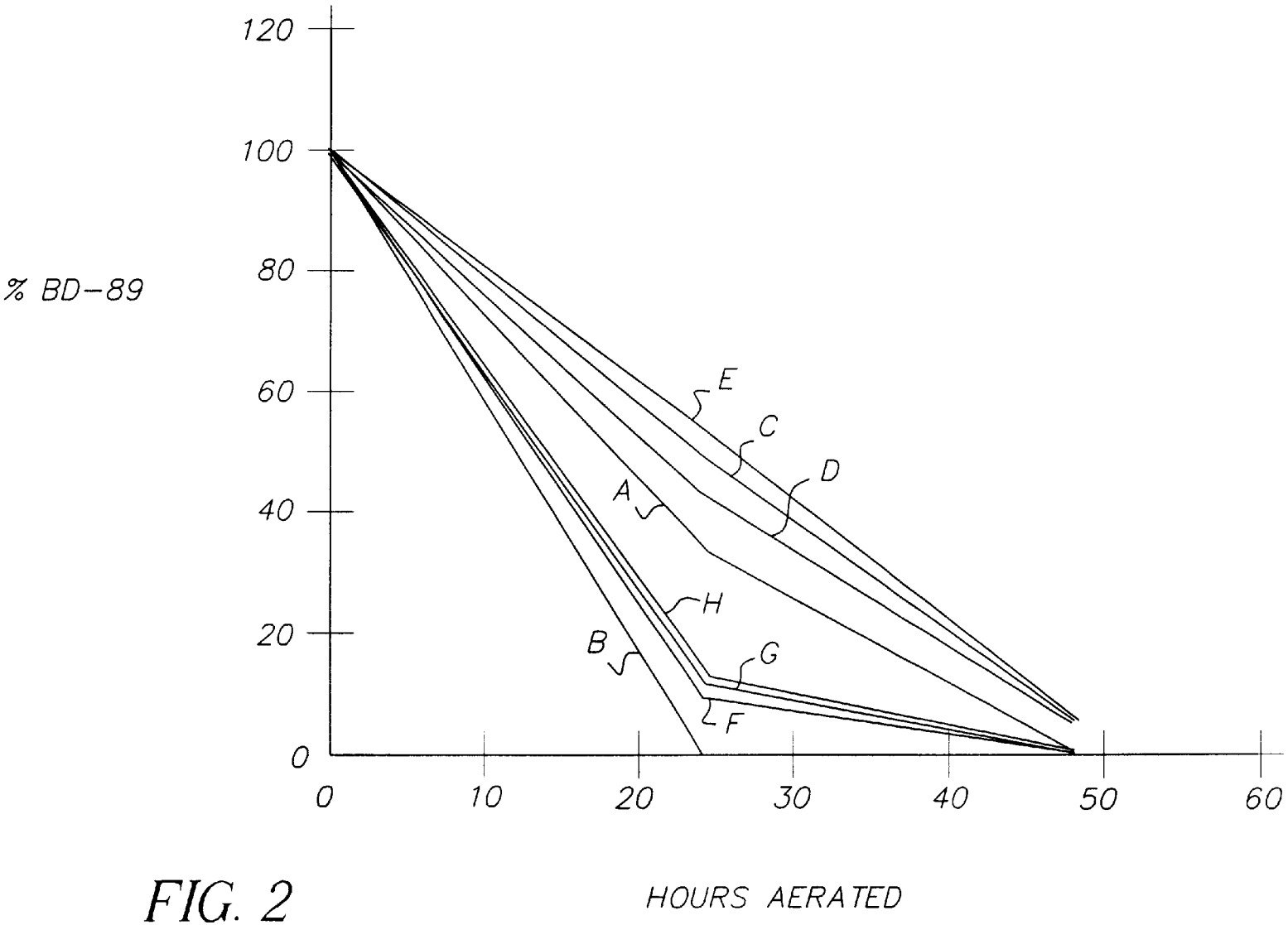

Each composition was allowed to stand in ambient room temperature and evaluated as described in Example 4. The results are shown in FIGS. 1 and 2 where the change (loss) in color developing agent (FIG. 1) and hydroxylamine derivative (FIG. 2) are indicated for the hours of aeration that simulate photoprocessing conditions. These results indicate that pyruvic acid or a salt thereof can also significantly improved the stability (that is, reduced the loss in activity) of the antioxidant and the color developing agent in the single part color developing compositions.

TABLE VIII

| COMPONENT | CONTROL D (AMOUNT) |
|---|---|
| Water | 800 ml |
| Triethanolamine (85%) | 2.99 g |
| N,N-diethylhydroxylamine antioxidant | 0.04 mol/l |
| Sodium Pyruvate | 0 |
| Phorwite REU optical brightener | 1.11 g |
| DEQUEST ™ 2066 sequestering agent | 5.2 g |
| DEQUEST ™ 2010 sequestering agent | 0.072 g |
| Diethylene glycol | 79.4 g |
| Potassium bromide | 0.03 g |
| KODAK Color Developing Agent CD-3 | 0.016 mol/l |
| Potassium carbonate (47%) | 45.9 g |
| Sodium hydroxide (50%) | 3.99 g |
| Potassium bicarbonate | 1.9 g |
| Water | To make 1 liter |

TABLE XI

| COM-POSITION | FIGS. 1 and 2 | PYRUVATE | HYDROXY-LAMINE DERIVATIVE |
|---|---|---|---|
| Control D | Curve A | 0 | 2.6 ml (0.045 mol/l) |
| Control E | Curve B | 0 | 1.3 ml (0.023 mol/l) |
| Example 6 | Curve C | 2.38 g/l (0.027 mol/l) | 2.6 ml (0.045 mol/l) |
| Example 7 | Curve D | 3.96 g/l (0.045 mol/l) | 2.6 ml (0.045 mol/l) |
| Example 8 | Curve E | 8.8 g/l (0.1 mol/l) | 2.6 ml (0.045 mol/l) |
| Example 9 | Curve F | 2.39 g/l (0.027 mol/l) | 1.3 ml (0.023 mol/l) |
| Example 10 | Curve G | 3.96 g/l (0.045 mol/l) | 1.3 ml (0.023 mol/l) |
| Example 11 | Curve H | 8.8 g/l (0.1 mol/l) | 1.3 ml (0.023 mol/l) |

EXAMPLES 12–15

Color Developing Composition Containing Glyoxylic Acid

Working strength color developing of this invention was also prepared using glyoxylic acid as the stabilizing agent and stability comparisons were made with other compositions of the invention and a Control composition.

The compositions used in this example were as follows:

Control F: Conventional Kodak Ektacolor RA Prime Color Developer,

Example 12: Control F with the addition of 0.01 mol/l of sodium pyruvate,

Example 13: Control F with the addition of 0.02 mol/l of sodium pyruvate,

Example 14: Control F with the addition of 0.027 mol/l of glyoxylic acid,

Example 15: Control F with the addition of 0.1 mol/l of glyoxylic acid.

Aeration studies were carried out as described in Examples 2–4. The following TABLES XII and XII provide the results of loss of color developing agent and hydroxylamine derivative.

TABLE XII

| | Color Developing Agent Remaining (%) | | | | |
|---|---|---|---|---|---|
| Time (hours) | Control F | Example 12 | Example 13 | Example 14 | Example 15 |
| 0 | 100 | 100 | 100 | 100 | 100 |
| 24 | 95.96 | 97.66 | 98.61 | 98.83 | 97.08 |
| 48 | 83.48 | 87.85 | 90.56 | 91.82 | 92.92 |
| 72 | 33.04 | 51.39 | 60.91 | 59.27 | 73.58 |

TABLE XIII

| | Hydroxylamine Derivative Remaining (%) | | | | |
|---|---|---|---|---|---|
| Time (hours) | Control F | Example 12 | Example 13 | Example 14 | Example 15 |
| 0 | 100 | 100 | 100 | 100 | 100 |
| 24 | 55.65 | 64.52 | 67.75 | 65.57 | 69.35 |
| 48 | 10.48 | 21.77 | 25.81 | 25.41 | 34.68 |

These results show that lower levels of sodium pyruvate also improve the stability of the color developing composition of this invention. Additionally, the results show that glyoxylic acid, another α-ketocarboxylic, can also be used to improve the stability of the color developing composition.

The invention has been described in detail with particular reference to preferred embodiments thereof, but it will be understood that variations and modifications can be effected within the spirit and scope of the invention.

We claim:

1. A concentrated aqueous photographic color developing composition having a pH of from about 7 to about 13 and comprising:

a) at least 0.005 mol/l of a color developing agent, b) at least 0.005 mol/l of an antioxidant for said color developing agent, and c) from about 0.01 to about 2.5 mol/l of an α-ketocarboxylic acid or salt thereof as a stabilizing agent.

2. The color developing composition of claim 1 having a pH of from about 8 to about 12.

3. The color developing composition of claim 1 wherein said color developing agent is present in an amount of from about 0.05 to about 0.8 mol/l, and said antioxidant is present in an amount of from about 0.05 to about 1 mol/l.

4. The color developing composition of claim 1 wherein said antioxidant is a hydroxylamine derivative.

5. The color developing composition of claim 4 wherein said antioxidant has one or more sulfo, carboxy, or hydroxy solubilizing groups.

6. The color developing composition of claim 1 further comprising a water-miscible or water-soluble hydroxy-substituted, straight-chain organic solvent that has a molecular weight of from about 50 to about 200.

7. The color developing composition of claim 6 further comprising a buffering agent that is soluble in said organic solvent.

8. The color developing composition of claim 1 further comprising a carbonate buffering agent.

9. The color developing composition of claim 1 further comprising one or more calcium ion sequestering agents.

10. The color developing composition of claim 9 comprising at least one polyphosphonic acids or salts thereof as a calcium ion sequestering agent, one of which is a polyaminopolyphosphonic acid or salt thereof that is present in an amount of from about 0.005 to about 0.3 mol/l or a diphosphonic acid or salt thereof that is present in an amount of up to 0.3 mol/l.

11. The color developing composition of claim 10 wherein said polyaminopolyphosphonic acid or a salt thereof is represented by the following Structure I:

I

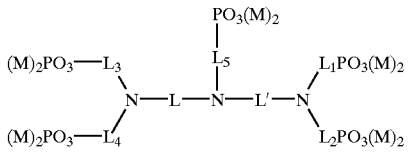

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation, and wherein said diphosphonic acid or salt thereof is a hydroxyalkylidene diphosphonic acid or a salt thereof is represented by te following Structure II:

II

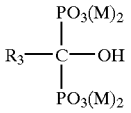

wherein $R_3$ is an alkyl group of 1 to 5 carbon atoms, and M is hydrogen or a monovalent cation.

12. The color developing composition of claim 1 wherein said α-ketocarboxylic acid or salt thereof is pyruvic acid, oxalacetic acid, glyoxylic acid, mesoxalic acid, 2-ketobutyric acid, 2-ketoglutaric acid, or an ammonium, alkali metal, or alkaline earth metal salt thereof, which acid or salt thereof is present in an amount of from about 0.02 to about 2 mol/l.

13. The color developing composition of claim 12 wherein said α-ketocarboxylic acid or salt thereof is pyruvic acid, glyoxylic acid, or a salt thereof.

14. A concentrated, aqueous, single-part color developing composition having a pH of from about 8 to about 12 and comprising:

a) from about 0.005 to about 1 mol/l of a color developing agent in free base form, b) from about 0.005 to about 1 mol/l of a hydroxylamine derivative antioxidant for said color developing agent, c) a water-miscible or water-soluble hydroxy-substituted, straight-chain organic solvent that has a molecular weight of from about 50 to about 200, d) a buffering agent that is solvent in said organic solvent, e) from about 0.005 to about 0.3 mol/l of a calcium ion sequestering agent, and f) at least 0.01 mol/l of an α-ketocarboxylic acid, or a salt thereof, as a stabilizing agent.

15. The color developing composition of claim 14 comprising pyruvic acid as said stabilizing agent.

16. An aqueous working strength color developing composition prepared by diluting a concentrated aqueous color developing composition at least two times, said concentrated aqueous photographic color developing composition having a pH of from about 7 to about 13 and comprising:

a) at least 0.005 mol/l of a color developing agent, b) at least 0.005 mol/l of an antioxidant for said color developing agent, and c) from about 0.005 to about 2.5 mol/l of an α-ketocarboxylic acid or salt thereof as a stabilizing agent.

17. An aqueous working strength color developing composition having a pH of from about 7 to about 13 and comprising:

a) at least 0.0005 mol/l of a color developing agent, b) at least 0.0005 mol/l of an antioxidant for said color developing agent, and c) from about 0.005 to about 0.25 mol/l of an α-ketocarboxylic acid or salt thereof as a stabilizing agent.

18. A method for providing a color image in a color photographic silver halide element comprising contacting said element with a concentrated aqueous photographic color developing composition having a pH of from about 7 to about 13 and comprising:

a) at least 0.005 mol/l of a color developing agent, b) at least 0.005 mol/l of an antioxidant for said color developing agent, and c) from about 0.01 to about 2.5 mol/l of an α-ketocarboxylic acid or salt thereof as a stabilizing agent.

19. A method for providing a color image in a color photographic silver halide element comprising contacting said element with an aqueous working strength color developing composition prepared by diluting a concentrated aqueous color developing composition at least two times, said concentrated aqueous photographic color developing composition having a pH of from about 7 to about 13 and comprising:

a) at least 0.005 mol/l of a color developing agent, b) at least 0.005 mol/l of an antioxidant for said color developing agent, and c) from about 0.01 to about 2.5 mol/l of an α-ketocarboxylic acid or salt thereof as a stabilizing agent.

20. A method of photographic processing comprising the steps of:

A) color developing an imagewise exposed color photographic silver halide element with a photographic color developing composition comprising an α-ketocarboxylic acid or salt thereof, and B) desilvering said color developed color photographic silver halide element.

21. The method of claim 20 wherein said photographic color silver halide element is a color paper.

22. The method of claim 20 carried out in a minilab.

* * * * *